US005913932A

United States Patent [19]

Takayama

[11] Patent Number: 5,913,932

[45] Date of Patent: Jun. 22, 1999

[54] TRANSFER PRESS

[75] Inventor: Yukiyoshi Takayama, Komatsu, Japan

[73] Assignee: Komatsu Ltd., Tokyo, Japan

[21] Appl. No.: 09/051,635

[22] PCT Filed: Jan. 8, 1997

[86] PCT No.: PCT/JP97/00047

§ 371 Date: Apr. 16, 1998

§ 102(e) Date: Apr. 16, 1998

[87] PCT Pub. No.: WO97/28912

PCT Pub. Date: Aug. 14, 1997

[30] Foreign Application Priority Data

Feb. 8, 1996 [JP] Japan ..... 8-022864

[51] Int. Cl.[6] ..... B21D 43/05

[52] U.S. Cl. ..... 72/405.09; 72/405.01; 72/1; 198/621.1

[58] Field of Search ..... 72/405.01, 405.09, 72/405.13, 405.16, 1; 198/507, 719, 621.1

[56] References Cited

U.S. PATENT DOCUMENTS

| | | | |
|---|---|---|---|
| 3,701,414 | 10/1972 | Mayer | 198/203 |
| 4,449,083 | 5/1984 | Beall | 72/22 |
| 4,664,247 | 5/1987 | Wolf | 198/323 |

FOREIGN PATENT DOCUMENTS

| | | | |
|---|---|---|---|
| 283426 | 12/1986 | Japan | 72/405.01 |
| 4-270098 | 9/1992 | Japan | 72/405.01 |
| 5-324027 | 12/1993 | Japan | 72/405.01 |
| 106271 | 4/1994 | Japan . | |
| 6-106271 | 4/1994 | Japan | 72/405.01 |
| 6-179099 | 6/1994 | Japan | 72/405.01 |
| 7-47497 | 2/1995 | Japan | 72/405.01 |

*Primary Examiner*—Daniel C. Crane
*Attorney, Agent, or Firm*—Armstrong, Westerman, Hattori, McLeland, & Naughton

[57] ABSTRACT

Synchronous driving of a press system and a transfer system at the time of failure is achieved by employing an extremely inexpensive arrangement. A capacitor is provided in an electric supply line for servo motors incorporated in the transfer system, for supplying energy to the servo motors in the event of power failure. There are provided a power failure sensor for sensing power failure and an uninterruptible power supply unit for supplying energy to a control system (a transfer system controller, relay logic and others) for controlling the servo motors, when the power failure sensor senses power failure.

4 Claims, 4 Drawing Sheets

2: TRANSFER SYSTEM

5: PRESS CONTROLLER

8: FLYWHEEL UNIT

23: TRANSFER SYSTEM CONTROLLER

25: CONVERTER

28: CONTROL CIRCUIT

30: RELAY LOGIC

32: UNINTERRUPTIBLE POWER SUPPLY UNIT

52: CONVERTER

54: POWER TRANSMISSION

55: CONTROL CIRCUIT

56: CONTROLLER

57: RELAY LOGIC

TRANSFER PRESS

This application is a 371 of PCT/JP97/00047, filed Jan. 8, 1997.

TECHNICAL FIELD

The present invention relates to a transfer press and more particularly to a transfer press with a transfer system which includes servo motors as drive sources to transfer workpieces to be pressed.

BACKGROUND OF THE INVENTION

There are known transfer presses which include a transfer system for conveying workpieces to be pressed through a series of work stations in timed relation with performance of a series of pressing operations. Typically, the transfer system comprises a pair of feed bars juxtaposed so as to extend in a workpiece transferring direction and cross bars each spanned between these feed bars. The transfer system conveys workpieces held by vacuum caps by vacuum adsorption, these vacuum caps being attached to the cross bars. Alternatively, the transfer system conveys workpieces gripped at both sides by fingers attached to the feed bars. In this case, the pair of feed bars perform two-dimensional or three-dimensional movement to transfer an individual workpiece from one station where a set of dies are disposed to the next adjacent station where another set of dies are disposed.

The most typical method for driving the feed bars is a mechanical driving method in which the feed bars are driven, being linked to the press system with a cam and link mechanism. This method however reveals the disadvantage that the alignment of dies at the time of die replacement is extremely difficult and therefore the individual driving method becomes prevailing recently according to which the feed bars are driven with motors (servo motors) different from the motor for the press system.

There is the danger in such transfer presses having a transfer system driven by the individual driving method that the servo motor is brought into a free-running condition in the event of power failure during the operation of the feed bars, which would cause an interference, for instance, between the cross bars and the dies. To reduce the danger, such transfer presses are provided with a mechanism for rapidly bringing the servo motors to a stop in case of power failure.

This transfer system stopping mechanism incorporated in prior art transfer presses will be described with reference to FIG. 4. In FIG. 4, servo motors 50, 50' for driving feed bars (not shown) are connected to an a.c. power source 53 through their respective servo amplifiers 51, 51' and a converter 52. Each servo amplifier 51 (51') is provided with a control circuit 55 for outputting a control signal to a power transmission 54 for each servo motor 50 (50') to control the rotation of the servo motor 50 (50'). Each control circuit 55 is actuated in response to a command signal sent from a controller 56 and to a start signal from a relay logic 57. Each control circuit 55 is supplied with control power (400V) from the a.c. power source 53 and a capacitor 58 is connected to a point on the electric supply line of each control circuit 55 in order to back up the power source 53 in the event of power failure. A regenerative resistance 59 is connected to the converter 52, for consuming, as heat, regenerative energy that is generated during braking of the servo motors 50, 50'.

In the above circuit configuration, if the a.c. power source 53 is interrupted because of power failure, the supply of power to the electric supply line and therefore to the controller 56, control circuit 55 and relay logic 57 is interrupted. When the start signal from the relay logic 57 goes down, the servo amplifiers 51, 51' mask a command from the controller 56 and the internal logic is put in operation to stop the motors. Concretely, the regenerative energy that has been generated during braking of the servo motors 50, 50' is released to the regenerative resistance 59 as indicated by arrow E whereby the energy is consumed as heat to forcibly bring the servo motors 50, 50' to a stop. In order to allow the control circuits 55 of the servo amplifiers 51, 51' to perform the control for releasing the regenerative energy, the control circuits 55 are supplied with energy drawn (as indicated by arrow F) from the respective capacitors 58 for backing up the power source, until the motors are stopped. Accordingly, the servo motors 50, 50' can be rapidly stopped even in the event of power failure.

When power failure occurs, the press slide of the press system is braked for an emergency stop because no electric power is supplied. Accordingly, the press system and the transfer system are independently interrupted in the case of power failure. In this case, there is no problem if the press slide and the transfer system can be stopped at the same time. However, in reality, the transfer system is stopped before a stop of the press slide because the inertia force of the press slide is much greater than that of the transfer system. When such an emergency stop occurs, there is the danger depending on the stop position of the transfer system that the press slide would interfere with the transfer system because of the inertia of the press slide, resulting in damage to or destruction of the press dies or transfer system which are very costly.

Attempts to solve this problem are proposed in Japanese Patent Laid-Open Publications No. 5-324027 (1993) and No. 6-106271 (1994). These publications disclose transfer presses in which if a supply of electric power is interrupted due to power failure, regenerative power which has been generated in the main motor coupled to the flywheel of the press system is fed to the servo motors of the transfer system so that synchronous driving of the press system and the transfer system can be maintained even in the case of power failure.

The driving circuits for the transfer motors disclosed in the above publications are provided with an inverter for converting d.c. voltage into a.c. motor driving voltage. The d.c. voltage supplied to this inverter varies according to the types of the motors employed and it is therefore essential to equip the driving circuits with a converting system (DC/DC converter) for converting the d.c. voltage into optimum voltage. Such a converting system is very expensive, which is an obstacle to practical use of transfer presses of the type disclosed in the above publications.

The present invention is directed to overcoming the foregoing problems and it is therefore one of the objects of the invention to provide a transfer press which enables, with an extremely inexpensive arrangement, synchronous driving of the press system and the transfer system in the case of power failure.

DISCLOSURE OF THE INVENTION

The above object can be accomplished by a transfer press constructed according to the invention which includes a transfer system for transferring workpieces to be pressed, using servo motors as drive sources, wherein a capacitor for supplying, in the event of power failure, the servo motors with energy sufficient to drive the transfer system until a press system stops is disposed in an electric supply line for the servo motors.

According to the invention, since the capacitor can store enough energy to drive the transfer system until the press system stops in the event of power failure, energy (electric power) can be continuously supplied to the servo motors by the capacitor even if a supply of power to the electric supply line from the power source is interrupted owing to power failure. Accordingly, the transfer system can be driven in relation with the inertial driving of the press system even at the time of power failure, which ensures synchronous driving of the press system and the transfer system. With this arrangement, such an accident that the dies would interfere with the cross bars, finger operators or other members can be prevented even when the dies disposed in the press system are in descendent movement. The transfer press constructed according to the invention does not require such an expensive converting system as used in the prior art and can achieve the desired effect at low cost by adding only a capacitor to an ordinary system.

Preferably, the transfer press of the invention further comprises a power failure sensor for sensing power failure and an uninterruptible power supply unit which supplies energy to a control system for controlling the servo motors, when the power failure sensor senses power failure. With this arrangement, in the event of power failure, the uninterruptible power supply unit supplies energy to the control system for the servo motors so that the control system and therefore the servo motors can be continuously, normally operated.

Preferably, the capacitor stores regenerative energy which is generated from deceleration of the servo motors and utilizes the regenerative energy in acceleration of the servo motors. This leads to efficient use of energy and enables energy saving.

Preferably, the capacitor is provided with a capacitive detector which given an alarm when the capacity of the capacitor drops. With this arrangement, shortage of capacity in the capacitor can be checked so that the transfer system can be prevented from abnormally working in the event of power failure.

BEST MODE FOR CARRYING OUT THE INVENTION

Figure 1:
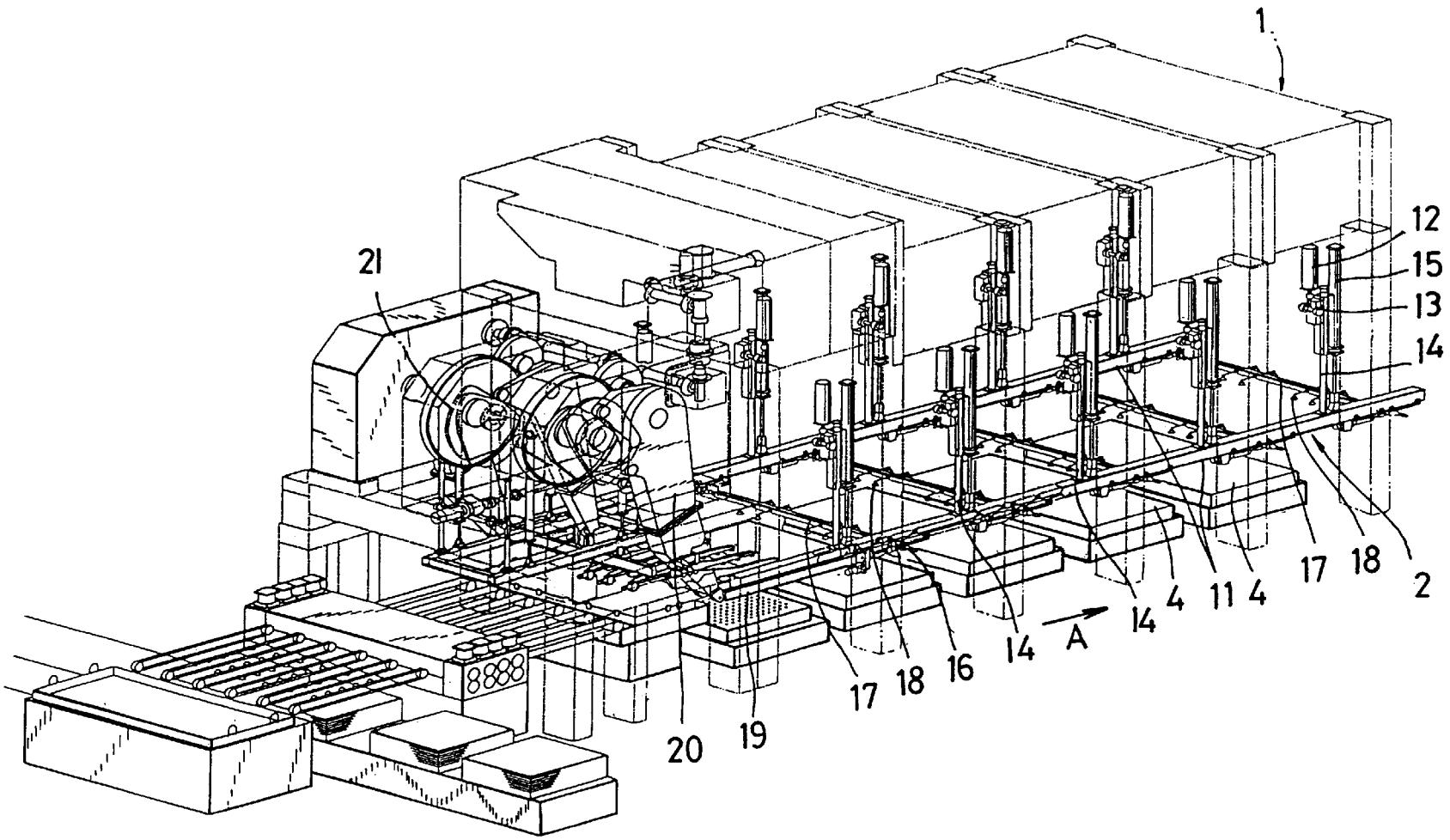
FIG. 1 is a schematic general perspective view of a transfer press according to one embodiment of the invention.

Referring now to the drawings, a preferred embodiment of the transfer press of the invention will be hereinafter described.

Figure 2:
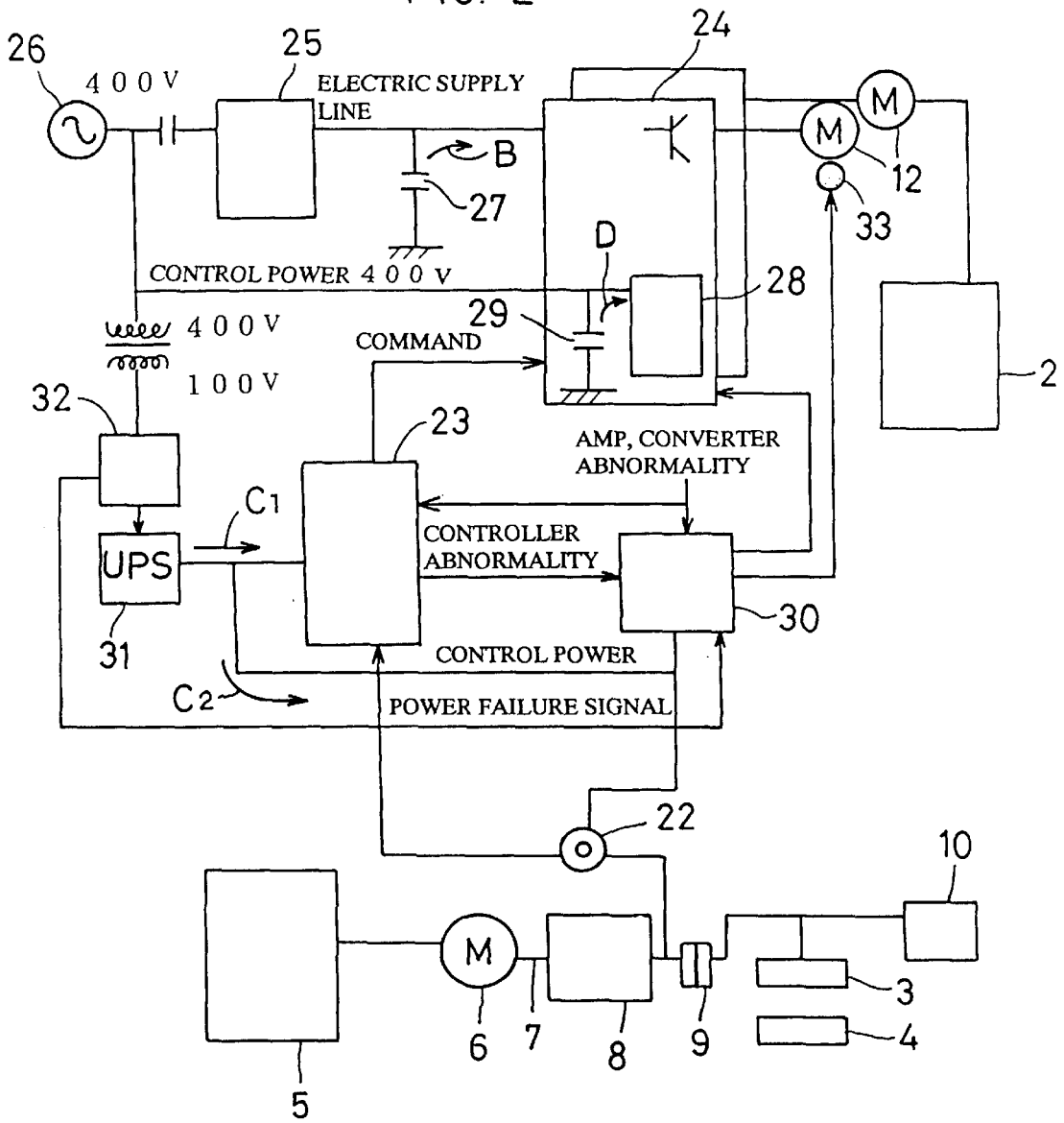
FIG. 2 is a system configuration diagram of a system according to the invention for synchronously driving a press system and a transfer system in the event of power failure.

FIG. 1 schematically depicts a general, perspective view of a transfer press constructed according to one embodiment of the invention, and FIG. 2 depicts in block form a control system for this transfer press. As shown in FIG. 1, the transfer press according to this embodiment comprises a press system 1 and a transfer system 2. The press system 1 has a series of work stations which perform successive pressing operations on each workpiece (not shown) whereas the transfer system 2 is disposed within the press system 1, for transferring the workpieces in the feeding direction A.

The press system 1 includes a press slide 3 which is reciprocable vertically by slide driving mechanisms spanned at the respective work stations. Upper dies are attached to the underside of the press slide 3 while lower dies are so attached to moving bolsters 4 as to respectively face their corresponding upper dies so that pressing operations can be performed on the workpieces placed between these dies. Each of the slide driving mechanisms comprises a main motor 6 controlled in response to a signal from a press controller 5; a drive shaft 7 driven by the main motor 6; a flywheel unit 8 attached to the drive shaft 7; a clutch 9; and a brake 10.

The transfer system 2 has a pair of feed bars 11 juxtaposed so as to extend along the workpiece feeding direction A, being suspended from above by means of lift mechanisms attached to the press system 1. Each lift mechanism includes a pinion 13 rotated by a servo motor 12 and a rack rod 14 which meshes with the pinion 13. The feed bars 11 are supported at the lower end of each rack rod 14 and driven by the servo motors 12 to move vertically in synchronous relation with the movement of the press system 1. Balance cylinders 15 are disposed at positions adjacent the respective rack rods 14, for maintaining a balance between the fluid pressure on each balance cylinder 15 and the weight of the feed bars 11 etc. Supported at the undersides of the feed bars 11 are a plurality of cross bar carriers 16 which are spaced in the feeding direction A so as to be movable both in the feeding direction A and in a direction opposite to the feeding direction A. A cross bar 17 is spanned between each opposing pair of cross bar carriers 16 so as to extend in a direction perpendicular to the feeding direction A. The cross bars 17 respectively have vacuum cups 18 attached thereto for adsorbing the workpieces.

The cross bar carriers 16 adjacent to each other in the feeding direction A are coupled to each other by a coupling rod so that the cross bar carriers 16 can simultaneously move both in the feeding direction A and in a direction opposite thereto. The most upstream cross bar carrier 16 attached to each feed bar 11 is connected to the distal end of each cam lever 20 by means of a coupling rod 19. The base end of each cam lever 20 adjoins to a feed cam 21 which is rotatable by the power delivered from the press system 1. The rotation of the feed cams 21 brings the cam levers 20 in rocking movement thereby moving the cross bar carriers 16 both in the feeding direction A and in a direction opposite thereto.

The angle of rotation of the drive shaft 7 is detected by a press angle detector 22 and according to this detected press angle, the servo motors 12 are controlled by a transfer system controller 23 through the servo amplifiers 24. With this arrangement, the cross bar carriers 16 of the transfer system 2 reciprocate in the feeding direction A and in a direction opposite thereto synchronously with the movement of the press system 1 so that the vacuum cups 18 attached to the cross bars 17 successively transfer the adsorbed workpieces to the respective work stations.

Figure 3:
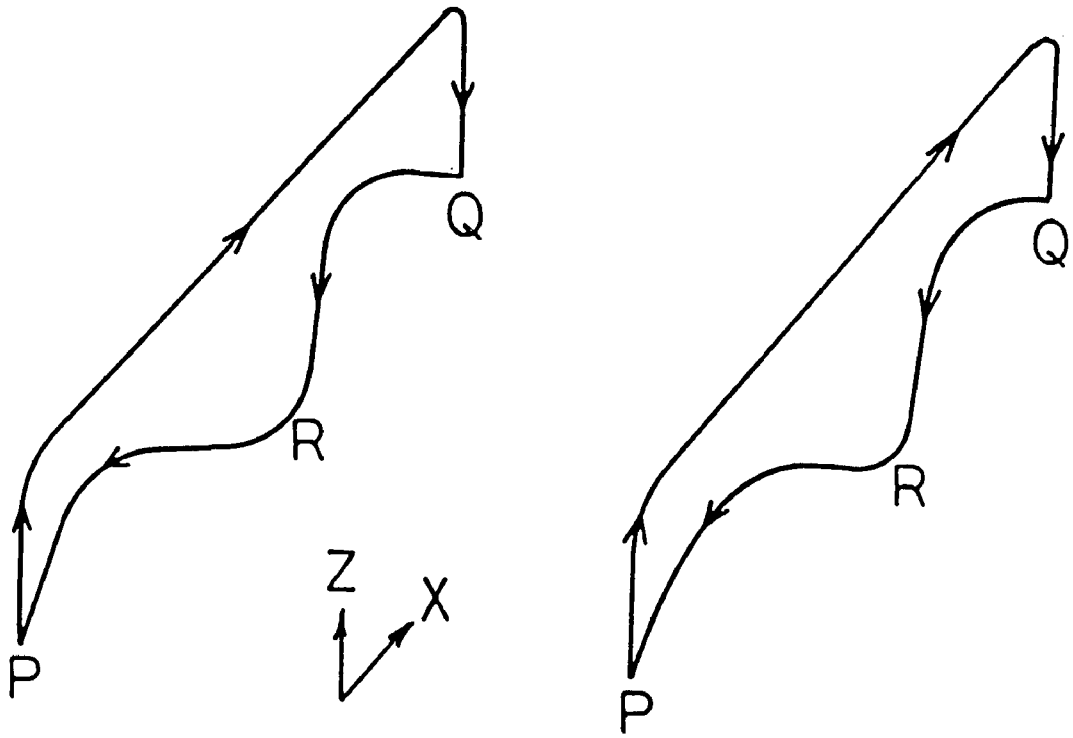
FIG. 3 depicts an example of the motion pattern of the transfer system.
Figure 4:
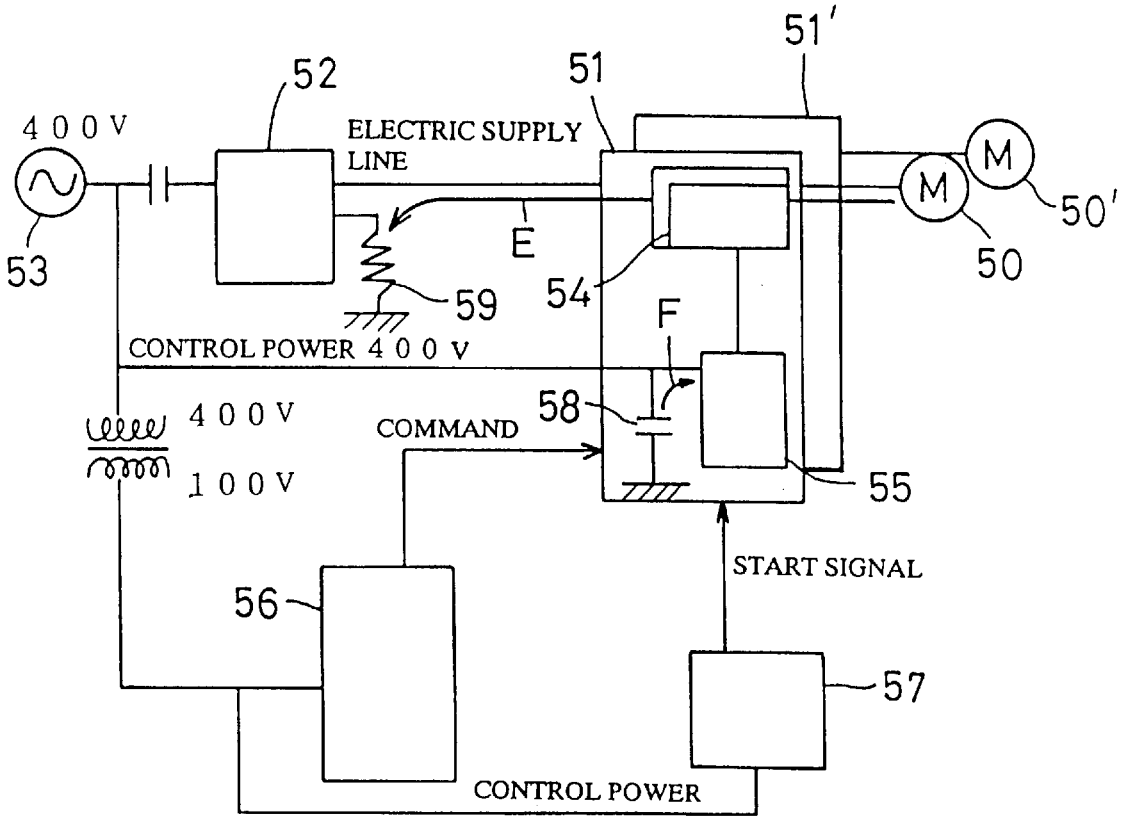
FIG. 4 is a system configuration diagram of a prior art system for stopping a transfer system in the event of power failure.

The transfer system 2 is driven according to a specified motion pattern in order to avoid the interference between the dies and the workpieces transferred by the transfer system 2. FIG. 3 shows one example of this motion pattern. The example shown in FIG. 3 is a two-dimensional motion pattern in which the cross bars 17 are moved two-dimensionally, that is, in the directions of X axis (i.e., feeding direction) and Z axis (i.e., lifting direction). According to this two-dimensional pattern, for moving onto the lower die of the previous work station, the transfer system 2 is first lifted at the stand-by point R, and then moved to and lowered at the adsorbing point P. At the adsorbing point P, the transfer system 2 adsorbs the workpiece to lift from the lower die in the direction of Z axis and then conveys it in the direction of X axis to the position above the lower die of the next station. To place the workpiece in this lower die, the transfer system 2 is lowered to release the workpiece at the releasing point Q. After releasing, the transfer system 2 is lifted and then moved back downwardly to the stand-by point R thereby terminating one cycle. Next, reference is made to FIG. 2 to describe the driving system for synchronously driving the press system 1 and the transfer system 2 in the event of power failure.

As shown in FIG. 2, the servo motors 12 for driving the transfer system 2 are connected to an a.c. power source 26 through their respective servo amplifiers 24 and a converter 25. Connected between the servo amplifiers 24 and the converter 25 is a large volume capacitor 27 for supplying energy to the servo amplifiers 24 during power failure. The capacitor 27 has capacity (e.g. 1.2F) sufficient to store energy which can drive the transfer system 2 until the press system 1 stops at the time of power failure. Each servo amplifier 24 includes a control circuit 28 for outputting a control signal to a power transmission to control the rotation of each servo motor 12. The control circuits 28 are supplied with control power (400V) delivered from the a.c. power source 26. Capacitors 29 are connected to points on the respective electric supply lines of the control power in order to back up the power source 26, by supplying the control circuits 28 with electric power in the event of power failure.

For backing up the transfer system controller 23, a relay logic 30 and the press angle detector 22 thereby to normally control the servo motors 12 in the event of power failure, an uninterruptible power supply unit (UPS) 31 is provided. In addition, a power failure sensor 32 is provided for outputting a power failure signal to the relay logic 30 and to the uninterruptible power supply unit 31 upon detection of power failure.

The relay logic 30 is designed to output a signal to operate a brake 33 for the servo motors 12 in response to an abnormality signal from the transfer system controller 23, the servo amplifiers 24 or the converter 25 if there occurs an abnormality in any of these members. If an abnormal condition occurs in the converter 25, an abnormality signal is also released to the transfer system controller 23, so that the abnormal condition of the converter 25 is displayed in the transfer system controller 23.

In such a system configuration, when power failure occurs, the clutch 9 interposed between the flywheel unit 8 and press slide 3 of the press system 1 is disengaged, interrupting the slide driving energy delivered from the flywheel unit 8 while the brake 10 is connected, so that the press slide 3 is brought to a stop.

Although a supply of energy from the a.c. power source 26 to the servo amplifiers 24 is also interrupted at the time of power failure, the servo amplifiers 24 are supplied with energy from the capacitor 27 (indicated by arrow B) so that the servo amplifiers 24 can be normally driven for a certain period of time. Additionally, the transfer system controller 23, relay logic 30 and press angle detector 22 are normally driven at the time of power failure with electric power (indicated by $C_1$, $C_2$) supplied from the uninterruptible power supply unit 31 and this backup electric power is interrupted after an elapse of a specified time after power failure occurred. In this way, the power failure signal from the power failure sensor 32 is also utilized as an interruption signal to interrupt the uninterruptible power supply unit 31 in order to prevent its over discharge. The control circuit 28 within each servo amplifier 24 is supplied with backup electric power from the capacitor 29 (indicated by arrow D) until the press slide 3 stops. When a supply of electric power to the converter 25 is interrupted, a signal indicative of the abnormal condition of the converter 25 is released to the relay logic 30 but this signal is masked by the power failure signal released from the power failure sensor 32 to the relay logic 30 so that the brake 33 is not put in operation at the time of power failure.

Accordingly, the servo amplifiers 24 are continuously supplied with energy by the capacitor 27 until the press slide 3 of the press system 1 stops in the event of power failure, so that the transfer system 2 can be driven in conjunction with the inertial driving of the press slide 3 and in consequence the synchronous driving of the press system 1 and the transfer system 2 can be ensured. This prevents the interference between the dies and the cross bars 17 etc. of the transfer system 2 even when the press slide 3 is in descendent movement. According to this embodiment, there is no need to install an expensive converting system such as a DC/DC converter to achieve the same functions as described earlier and the desired inventive effects can be accomplished by an inexpensive arrangement in which only a capacitor is newly adapted.

According to the embodiment, a preferable system is designed such that the capacitor 27 connected to the electric supply line stores the regenerative energy which is generated from deceleration of the servo motors 12 and utilizes the regenerative energy in acceleration of the servo motors 12. This leads to efficient use of energy. The capacitor 27 is preferably provided with a capacitive detector which given an alarm (i.e. sounds an alarm and/or lights a warning lamp) when the capacity of the capacitor 27 drops. With this arrangement, shortage of capacity in the capacitor can be checked so that the transfer system 2 can be prevented from abnormally working in the event of power failure.

I claim:

1. A transfer press which includes a transfer system for transferring workpieces to be pressed, using servo motors as drive sources, wherein a capacitor for supplying, in the event of power failure, the servo motors with energy sufficient to drive the transfer system until a press system stops is disposed in an electric supply line for the servo motors.

2. A transfer press according to claim 1, further comprising a power failure sensor for sensing power failure and an uninterruptible power supply unit which supplies energy to a control system for controlling the servo motors, when the power failure sensor senses power failure.

3. A transfer press according to claim 1, wherein said capacitor stores regenerative energy which is generated from deceleration of the servo motors and utilizes the regenerative energy in acceleration of the servo motors.

4. A transfer press according to any one of claims 1 to 3, wherein said capacitor is provided with a capacitive detector which gives an alarm when the capacity of the capacitor drops.

* * * * *